US009003951B2

(12) United States Patent
Sefcik

(10) Patent No.: US 9,003,951 B2
(45) Date of Patent: Apr. 14, 2015

(54) HYDRAULIC SYSTEM WITH BI-DIRECTIONAL REGENERATION

(75) Inventor: Edwin Sefcik, Elm Mott, TX (US)

(73) Assignee: Caterpillar Inc., Peoria, IL (US)

( * ) Notice: Subject to any disclaimer, the term of this patent is extended or adjusted under 35 U.S.C. 154(b) by 808 days.

(21) Appl. No.: 13/253,143

(22) Filed: Oct. 5, 2011

(65) Prior Publication Data

US 2013/0086899 A1 Apr. 11, 2013

(51) Int. Cl.

*F15B 11/036* (2006.01)
*F15B 11/024* (2006.01)
*F15B 15/14* (2006.01)

(52) U.S. Cl.

CPC ..... *F15B 11/024* (2013.01); *F15B 15/1466* (2013.01); *F15B 15/149* (2013.01); *F15B 2211/3133* (2013.01); *F15B 2211/7055* (2013.01)

(58) Field of Classification Search

CPC ..... F15B 11/036; F15B 11/0365; F15B 11/02
USPC ..... 91/436, 437; 92/51
See application file for complete search history.

(56) References Cited

U.S. PATENT DOCUMENTS

| | | | |
|---|---|---|---|
| 4,359,931 | A | 11/1982 | Palmersheim et al. |
| 5,329,767 | A | 7/1994 | Hewett |
| 5,440,968 | A | 8/1995 | Sekine |
| 5,577,433 | A | 11/1996 | Henry |
| 5,611,200 | A | 3/1997 | Moenkhaus |
| 5,634,389 | A | 6/1997 | Horan et al. |
| 5,941,158 | A | 8/1999 | Davies et al. |
| 6,467,264 | B1 | 10/2002 | Stephenson et al. |
| 6,474,215 | B1 | 11/2002 | Boyer et al. |
| 6,612,109 | B2 | 9/2003 | Mickelson |
| 7,370,569 | B2 | 5/2008 | Schmidt et al. |
| 8,567,185 | B1 | 10/2013 | Theobald et al. |
| 8,677,886 | B2 | 3/2014 | Cronin et al. |
| 2005/0066655 | A1 | 3/2005 | Aarestad et al. |
| 2007/0101861 | A1 | 5/2007 | Turner |
| 2008/0155975 | A1 | 7/2008 | Brinkman |
| 2010/0138051 | A1 | 6/2010 | Glime |
| 2012/0304633 | A1 | 12/2012 | Rozzi De Hieronymis |
| 2013/0213030 | A1 | 8/2013 | Sturmer |
| 2013/0255244 | A1 | 10/2013 | Shin et al. |
| 2013/0312599 | A1 | 11/2013 | Cover |
| 2014/0033698 | A1 | 2/2014 | Opdenbosch |
| 2014/0137956 | A1 | 5/2014 | Kim |

FOREIGN PATENT DOCUMENTS

| | | | |
|---|---|---|---|
| DE | 102007061078 | | 6/2009 |
| EP | 1580437 | | 9/2005 |
| EP | 1580437 | A1 * | 9/2005 |
| EP | 2107257 | | 10/2009 |
| FR | 2783514 | | 3/2000 |
| JP | 09222102 | | 8/1997 |
| JP | 2000329110 | | 11/2000 |
| JP | 2005083512 | | 3/2005 |
| JP | 2009047237 | | 3/2009 |

* cited by examiner

*Primary Examiner* — Nathaniel Wiehe
*Assistant Examiner* — Abiy Teka
(74) *Attorney, Agent, or Firm* — Finnegan, Henderson, Farabow, Garrett & Dunner, LLP

(57) ABSTRACT

A hydraulic actuator system including an actuator and a valve assembly configured for bi-directional regeneration. The actuator may include a hollow body and a rod disposed within and extending outwardly from the hollow body. The rod may include a first chamber within the rod and a piston disposed at one end of the rod, defining a second chamber and a third chamber within the hollow body. A valve assembly may be in fluid communication with a first conduit, a second conduit, the first chamber, the second chamber, and the third chamber, wherein the valve assembly is configured to selectively couple one of the first conduit and the second conduit to one or more of the first port, the second port, and the third port, wherein one of the first conduit and the second conduit is configured as a pressure source.

19 Claims, 8 Drawing Sheets

HYDRAULIC SYSTEM WITH BI-DIRECTIONAL REGENERATION

TECHNICAL FIELD

The present disclosure relates generally to a hydraulic circuit for a hydraulic actuator, and more particularly, to arrangements for a hydraulic actuator with internal bi-directional regeneration.

BACKGROUND

Machines, such as for construction and earthmoving as well as other applications, may include a variety of hydraulically actuated implements and/or tools, for example buckets, shovels, blades, scrapers, shears, etc., which may be mounted on a movable linkage. Control of the implements and/or linkage preferably include a timely response to operator input. Such hydraulic systems may include an actuator having a piston disposed within a hollow actuator body. A rod is attached to the piston and extends out of one end of the actuator body. The piston divides the compartment in the hollow actuator body into a rod-end chamber and a head-end chamber, wherein the rod may be extended and/or retracted by introducing pressurized fluid into the head-end chamber and/or the rod-end chamber, respectively, and evacuating fluid from the other chamber.

Generally, responsiveness (i.e. the time required for a rod to extend and/or retract) is proportional to the fluid flow rate and power is proportional to fluid pressure. Generally, under full power operation, fluid is introduced into one chamber while evacuating fluid from the other chamber to a drain or reservoir. Response time in a hydraulic actuator may be improved by directing fluid from the chamber being evacuated to the chamber being filled to increase flow and thus increase responsiveness (i.e. decrease response time). Operating conditions for a hydraulic actuator may be such that at certain times To increase the responsiveness, some hydraulic systems include a regeneration circuit configured to direct flow from one chamber to the other. For example, EP1580437A1 discloses a hydraulic actuator including a piston rod defining three chambers within the hydraulic actuator, a valve configuration, and a first and second supply line configured for extending and retracting the piston rod, respectively. EP1580437A1 discloses that the valve configuration and the first and second supply lines operate to extend and retract the piston rod by directing hydraulic fluid to and from the various chambers based on the differential pressure between the first supply line and the second supply line. The hydraulic system of the present disclosure includes a dedicated fluid supply line for extending the rod and a separate dedicated fluid supply line for retracting the rod.

In another example, JP2009047237A discloses a pair of hydraulic actuators capable of consistent performance without respect to outside forces. In this example, a first hydraulic actuator and a second hydraulic actuator are connected to allow fluid to be introduced from the first actuator body to the second actuator boy. In contrast, the present disclosure is directed to a hydraulic actuator and valve arrangement that allows for internal bi-directional regeneration within a single actuator.

In another example of a multi-chambered actuator, JP2000329110A discloses a hydraulic cylinder including a piston rod defining three chambers in fluid communication. The hydraulic cylinder includes a heating element attached to the end of the rod by an insulating material. The three chambers provide a fluid circulation circuit within the actuator. In the present disclosure, the chambers of the hydraulic actuator are separate to allow selective pressurization/depressurization of individual chambers depending on predetermined conditions.

SUMMARY OF THE INVENTION

One aspect of the present disclosure includes a hydraulic actuator system including an actuator and a valve assembly configured for bi-directional regeneration. The actuator may include a hollow body including a first end and a second end and a rod disposed within the hollow body and extending outwardly from the second end of the hollow body. The rod may include a first chamber within the rod and a piston disposed at one end of the rod. The piston in combination with the hollow body may define a second chamber and a third chamber. A tube may be attached to the first end of the housing extending into the first chamber and configured to cooperate with the rod. A first conduit and a second conduit may be provided. A valve assembly may be in fluid communication with the first conduit, the second conduit, the first chamber, the second chamber, and the third chamber, wherein the valve assembly is configured to selectively couple one of the first conduit and the second conduit to one or more of the first port, the second port, and the third port, wherein one of the first conduit and the second conduit is configured as a pressure source.

Another aspect of the present disclosure includes a method of providing bi-directional regeneration in a hydraulic actuator. The method may include providing an actuator having a hollow body including a first end and a second end, and a rod disposed within the hollow body and extending outwardly from the second end of the hollow body. The rod may include a first chamber within the rod and a piston disposed at one end of the rod. The piston in combination with the hollow body defining a second chamber and a third chamber. A tube may be attached to the first end of the housing extending into the first chamber and configured to cooperate with the rod. The method may further include providing a first conduit and a second conduit, wherein one of the first conduit and the second conduit is configured as a pressure source. The method may further include providing a valve assembly in fluid communication with the first conduit, the second conduit, the first chamber, the second chamber, and the third chamber. The method may further include configuring the valve assembly to selectively couple one of the first conduit and the second conduit to one or more of the first port, the second port, and the third port.

Another aspect of the present disclosure includes a machine including a hydraulic system configured for bi-directional regeneration. The machine may include a first member and a second member pivotally connected to the first member. The machine may also include an actuator having a hollow body including a first end and a second end, and a rod disposed within the hollow body and extending outwardly from the second end of the hollow body. The rod may include a first chamber within the rod, and a piston disposed at one end of the rod. The piston in combination with the hollow body defining a second chamber and a third chamber. A tube may be attached to the first end of the housing extending into the first chamber and configured to cooperate with the rod. The actuator may be coupled to the first member and the second member. A first conduit and a second conduit may be provided. A valve assembly may be in fluid communication with the first conduit, the second conduit, the first chamber, the second chamber, and the third chamber. The valve assembly may be configured to selectively couple one of the first conduit and the second conduit to one or more of the first port, the second port, and the third port. One of the first conduit and the second conduit is configured as a pressure source.

DETAILED DESCRIPTION

Figure 1:
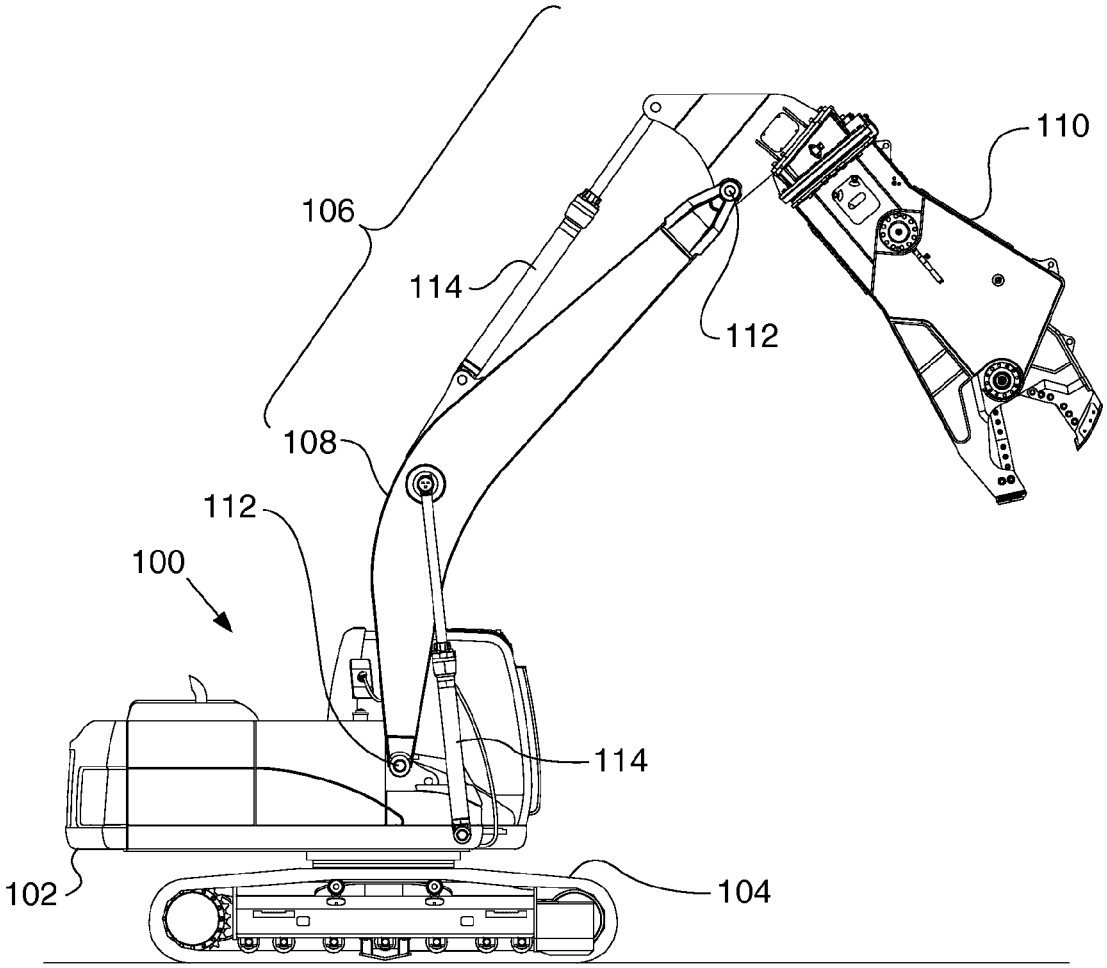
FIG. 1 is a side view of a machine including a hydraulic system of the present disclosure.

FIG. 1 shows an exemplary machine 100 having a machine body 102 mounted on an undercarriage 104. The machine 100 includes a linkage 106 having mating articulating components, such as, for example, a boom 108 and a work implement 110. Although in this exemplary embodiment the machine 100 is shown as an excavator having shears as the work implement, the machine 100 could be a backhoe, crane, loader, feller buncher, or any similar machine. The boom 108 and work implement 110 may be pivotally connected at one or more pinned joints 112. Movement of the linkage 106 may be achieved by a series of hydraulic actuators 114 coupled to the linkage 106 as is known in the art.

Figure 2:
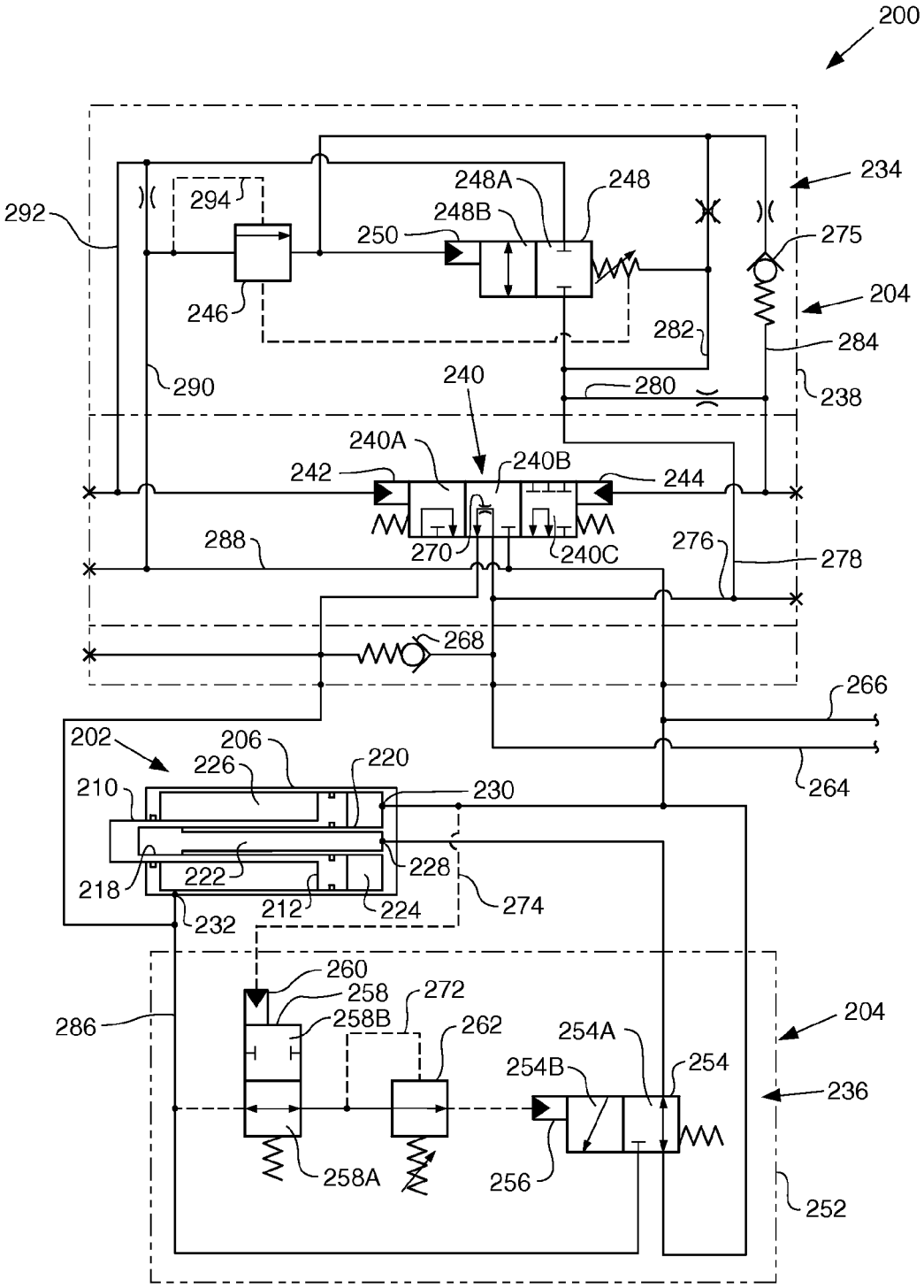
FIG. 2 is a schematic representation of the hydraulic system of the present disclosure.

Referring to FIG. 2, the hydraulic system 200 of the present disclosure may be configured to cooperate with one or more of the actuators 114 on machine 100. Therefore, the hydraulic system 200 shown in FIG. 2 may include a generic actuator 202, which may be configured for use in place of any of the actuators 114 on machine 100, or for any hydraulic actuator application known in the art. Hydraulic system 200 may also include a valve assembly 204 in fluid communication with the actuator 202.

Figure 3:
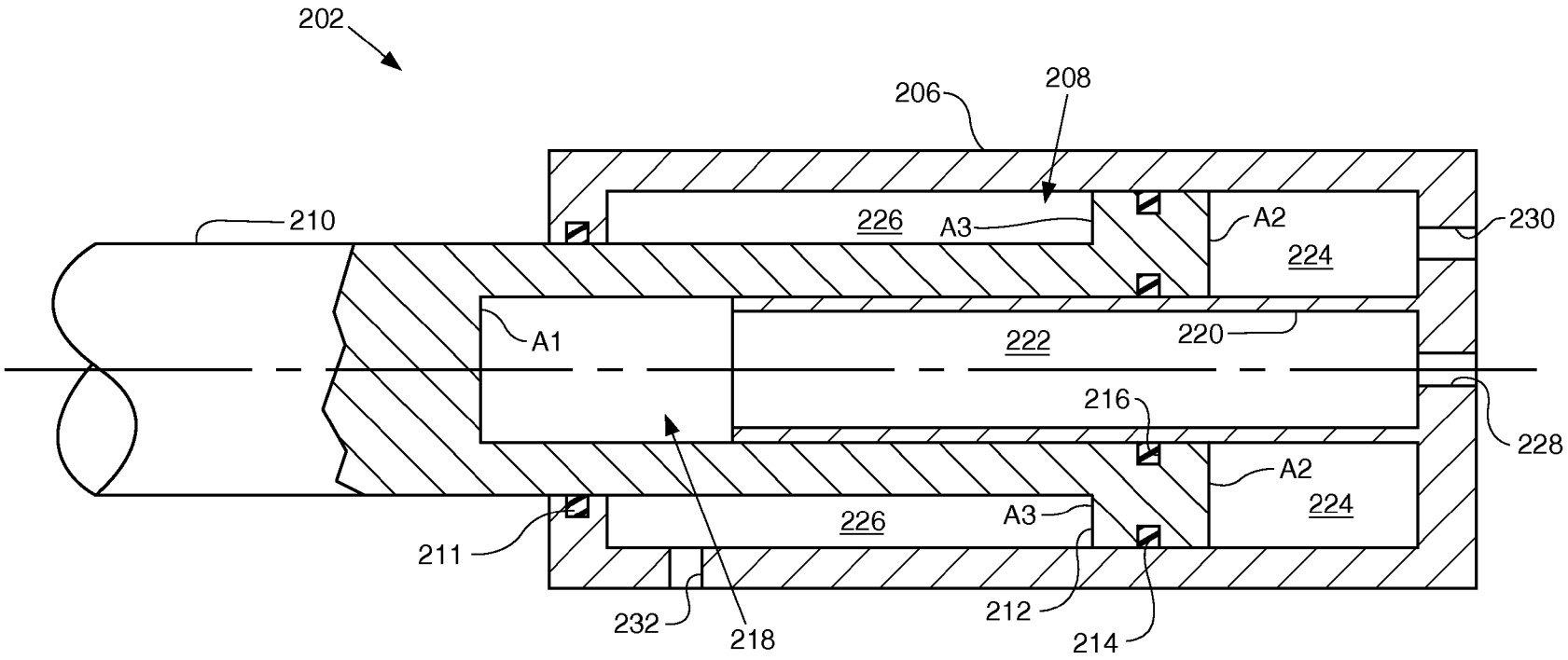
FIG. 3 is a detailed section view of an exemplary embodiment of a hydraulic actuator of the hydraulic system of FIG. 2.

Referring to FIG. 3, actuator 202 may include a hollow body 206 defining a compartment 208 within the body 206. Actuator 202 may also include a rod 210 slidably disposed within and extending from one end of the hollow body 206. A sealing ring 211 may be provided in hollow body 206 and configured to be disposed about and in sealing relation with rod 210. Rod 210 may include a piston 212 disposed on one end of the rod 210 within the compartment 208. Piston 212 may include one or more piston rings or piston seals. For example, in the embodiment shown in FIG. 3, the piston 212 includes an outer seal 214 and an inner seal 216, each in sealing arrangement in cooperation with an inner surface of compartment 208. Rod 210 may also include a bore 218 extending through the piston 212 and into the rod 210. A tube 220 may be disposed within the compartment 208, extending inwardly from the body 206 and configured to cooperate with the bore 218 within rod 210.

The compartment 208 may be divided into separate chambers, including a first chamber 222 including the region defined by the tube 220 in combination with the bore 218. Bore 218 may include a surface within the first chamber 222 having an area A1 against which fluid pressure may work. Compartment 208 may include a second chamber 224 including the region defined by the piston 212 and the head end of the body 206. Piston 212 may include a surface within the second chamber 224 having an area A2 against which fluid pressure may work. Compartment 208 may further include a third chamber 226 defined by the piston 212 and the rod end of the body 206. Piston 212 may include a surface within the third chamber 226 having an area A3 against which fluid pressure may work. Body 206 may include a first port 228 configured to allow fluid communication between the first chamber 222 and the valve assembly 204. Body 206 may also include a second port 230 configured to allow fluid communication between the second chamber 224 and the valve assembly 204. Body 206 may further include a third port 232 configured to allow fluid communication between the third chamber 226 and the valve assembly 204.

In the exemplary embodiment, hollow body 206, rod 210, bore 218, and tube 220, may be disposed in a coaxial arrangement, as shown in FIG. 3. Further, first chamber 222, second chamber 224, and third chamber 226 may be fluidically isolated from each other except through the valve assembly 204 as described below. It may be advantageous for the geometries of the first chamber 222, the second chamber 224 and the third chamber 226 be configured in proportional relationship. For example, it may be advantageous if the ratio of A1+A2:A3 is approximately 2:1. Also, it may be advantageous if the ratio of A3:A1 is approximately 2:1.

Figure 4:
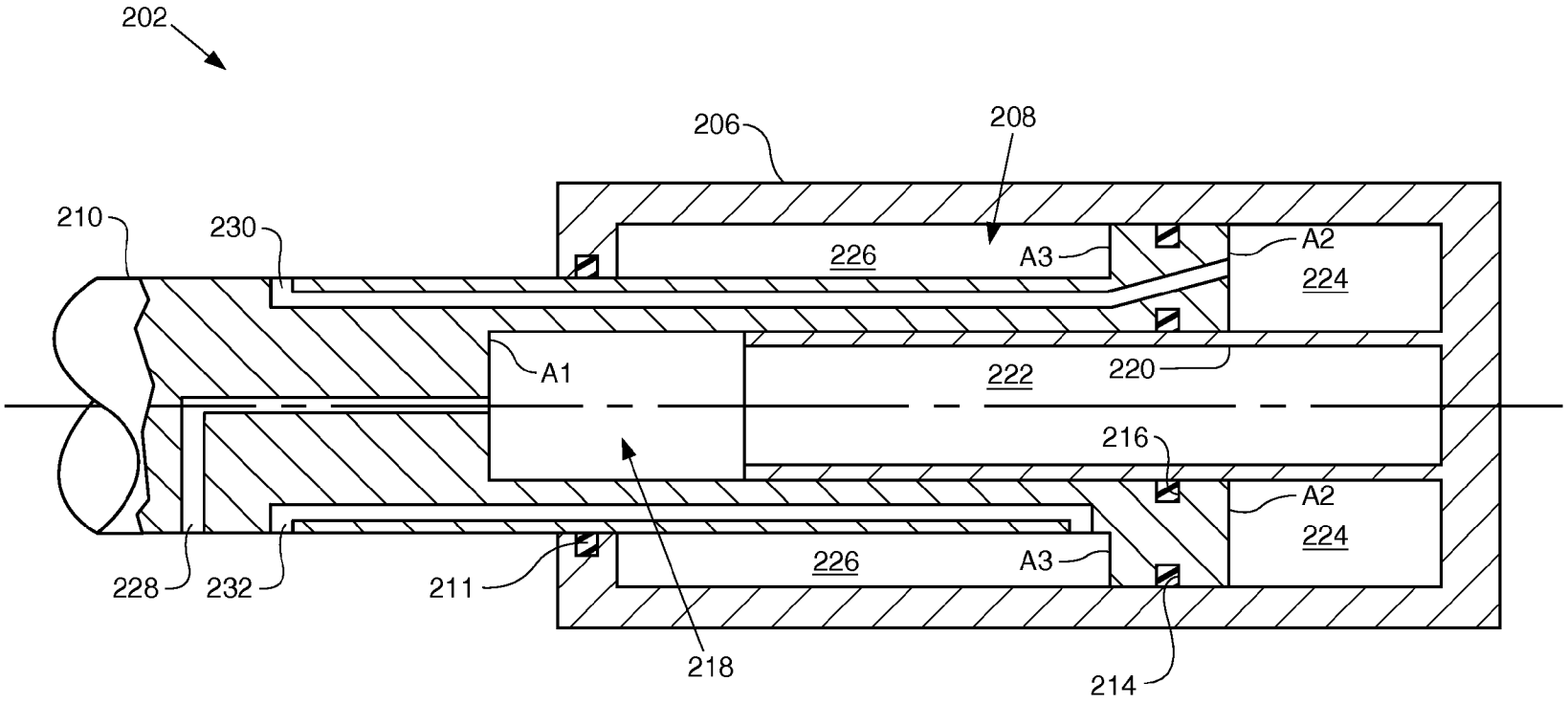
FIG. 4 is a detailed section view of an additional exemplary embodiment of a hydraulic actuator of the hydraulic system of FIG. 2.

The exemplary actuator 202 shown in FIG. 3 is configured such that the hollow body 206 is fixed, for example to a machine, and rod 210 extends and retracts in response to an operator's command. Alternatively, as shown in FIG. 4, rod 210 may be fixed and hollow body 206 may be configured to extend and retract. In this embodiment, ports 228, 230, and 232 may be disposed within rod 210 rather than the hollow body 206 to provide fluid communication between the valve assembly 200 shown in FIG. 2, and the first chamber 222, the second chamber 224 and the third chamber 226, respectively.

Referring again to FIG. 2, the valve assembly 204 may include an extend regeneration valve subassembly 234 and a retract regeneration valve subassembly 236. Although the extend regeneration valve subassembly 234 and retract regeneration valve subassembly 236 are shown separately in FIG. 2, it should be apparent that such valve subassemblies may be configured as a single part or as multiple parts depending on a particular application.

The extend regeneration valve assembly 234 may include a housing 238 enclosing a control valve 240. Control valve 240 may be configured as a spool valve having three ports and three positions. Control valve 240 may also include a first pilot actuator 242 and a second pilot actuator 244. The first pilot actuator 242 and a second pilot actuator 244 may be in fluid communication with a source of fluid pressure and are configured to operate the control valve 240 as described herein.

The extend regeneration valve assembly 234 may also include a priority valve 246 and a sequence valve 248. Sequence valve 248 may be configured as a spool valve having two ports and two positions. Sequence valve 248 may also include a pilot actuator 250. Pilot actuator 250 may be in fluid communication with priority valve 246.

The retract regeneration valve assembly 236 includes a housing 252 enclosing a control valve 254. Control valve 254 may be configured as a spool valve having three ports and two positions. Control valve 254 may also include a pilot actuator 256. The retract regeneration valve assembly 236 may also include a priority valve 258. Priority valve 258 may include a pilot actuator 260. The retract regeneration valve assembly 236 may also include a pressure limiting valve 262 in fluid communication with the priority valve 258 and the pilot actuator 256 on control valve 254.

Hydraulic system 200 may include a first conduit 264 and a second conduit 266. In the exemplary embodiment, first conduit 264 and second conduit 266 may be configured such that one of the first conduit 264 and the second conduit 266 is connected to a source of pressurized hydraulic fluid, such as a pump (not shown) while the other conduit is connected to an unpressurized drain or reservoir (not shown).

INDUSTRIAL APPLICABILITY

The hydraulic system 200 of the present disclosure may be applicable to a machine 100, as shown in FIG. 1, that includes a linkage 106 which may be operated by one or more hydraulic actuators 116. The hydraulic system 200 of the present disclosure may be applicable to the operation of hydraulic actuators using regeneration to decrease the cycle times for extending and refracting the rod of the actuator while allowing for full power operation when necessary.

Figure 2A:
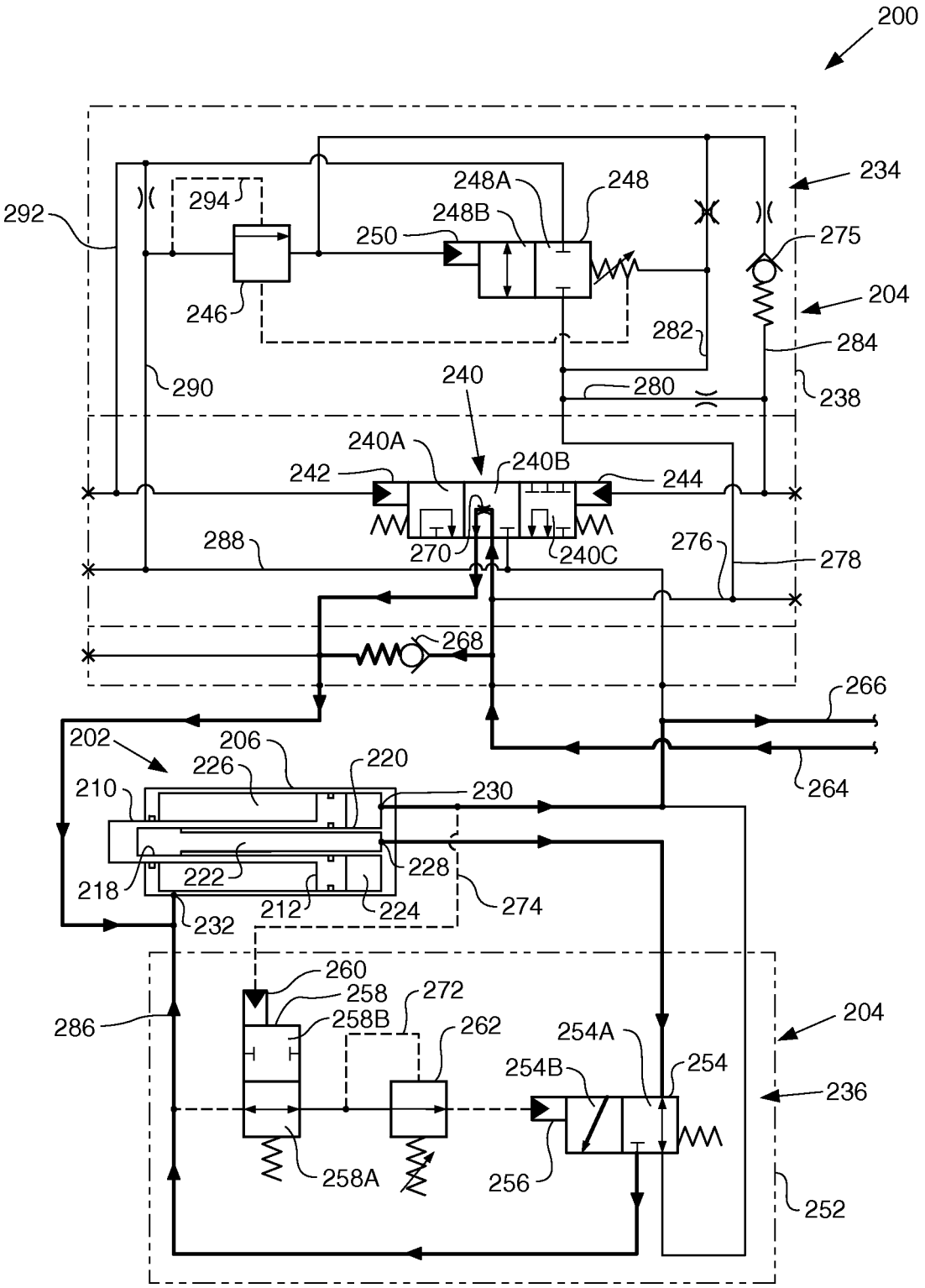
FIG. 2A is a schematic representation of the hydraulic system of FIG. 2 showing a fluid flow path in a first mode of operation.

In a first mode of operation, as shown in FIG. 2A with the fluid flow path shown in bold, the hydraulic system 200 may be configured to retract the rod 210 of actuator 202 using regeneration by directing flow of hydraulic fluid from the first chamber 222 to the third chamber 226. In this first mode of operation, pressurized hydraulic fluid may be supplied through first conduit 264. Control valve 240, being in its neutral position 240B, allows fluid to flow through orifice 270 in control valve 240 causing a downstream pressure drop. Hydraulic fluid is allowed to flow through orifice 270 to third port 232. Meanwhile, fluid pressure upstream of orifice 270 increases until sufficient to open check valve 268 allowing fluid to flow, in parallel, through check valve 268 and into third chamber 226 through third port 232.

As fluid is added to third chamber 226, rod 210 forces fluid to flow out of the first chamber 222. Priority valve 258 may be configured to have a normally open position 258A, allowing pressurized fluid to pass through to normally open pressure limiting valve 262, allowing fluid to operate pilot actuator 256, and thereby causing control valve 254 to move from its normal position 254A to position 254B, putting first chamber 222 in fluid communication with the third chamber 226 and allowing fluid to flow from first port 228 to third port 232. Meanwhile, in this configuration, second chamber 224 is in fluid communication with second conduit 266. Second conduit 266 may be in fluid communication with an unpressurized or low pressure drain or reservoir (not shown) which allows fluid to flow out of the second chamber 224 through the second port 230.

Figure 2B:
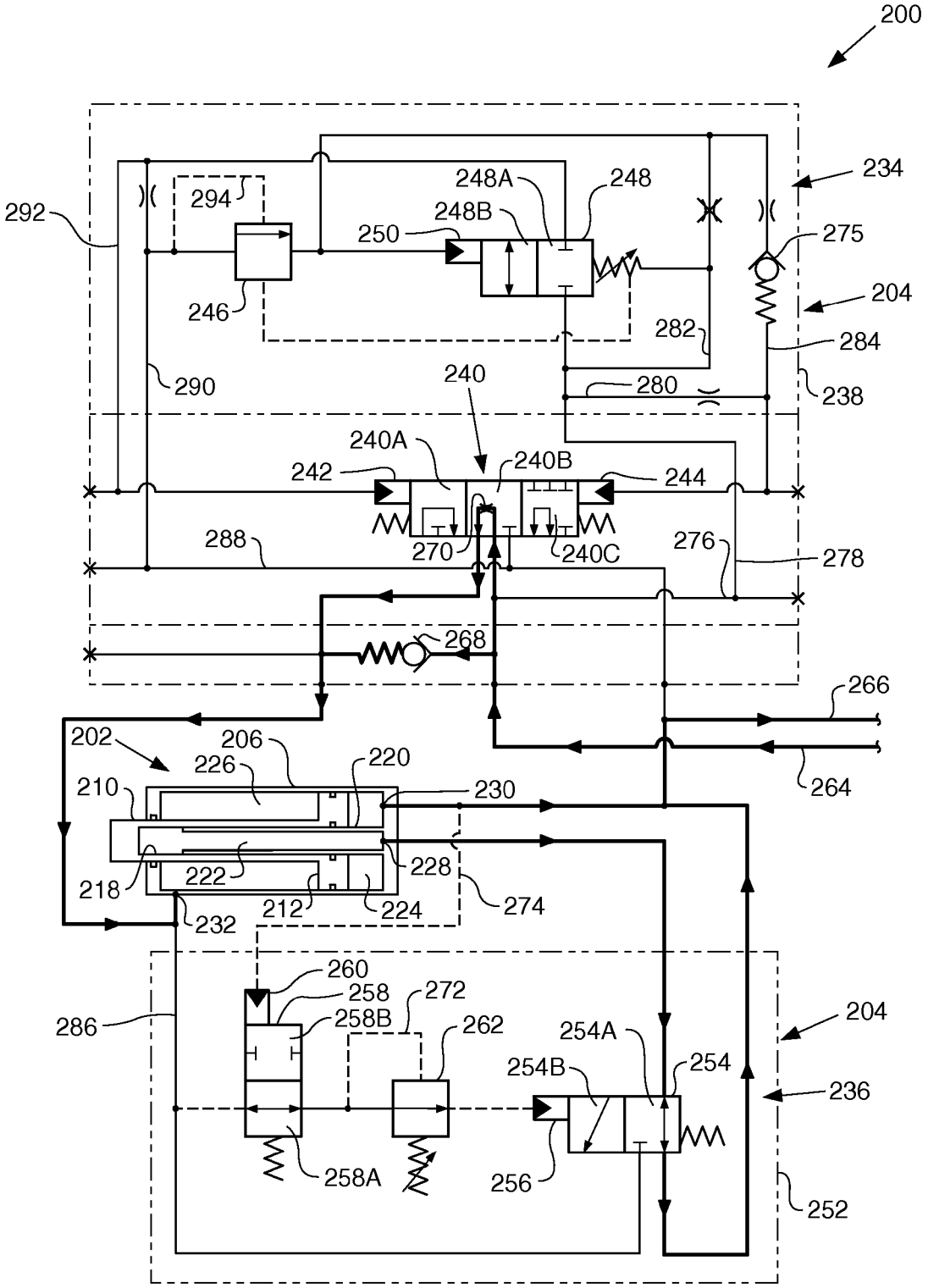
FIG. 2B is a schematic representation of the hydraulic system of FIG. 2 showing a fluid flow path in a second mode of operation.

In a second mode of operation, shown in FIG. 2B with the fluid flow path shown in bold, the hydraulic system 200 may be configured to retract the rod 210 of actuator 202 using full power by directing flow of hydraulic fluid into the third chamber 226 and by directing the flow of hydraulic fluid out of both the first chamber 222 and the second chamber 224 to a reservoir or drain. In this second mode of operation, pressurized hydraulic fluid may be supplied through first conduit 264 as shown in FIG. 2A and described previously. If there is a significant load on the work implement 112 and actuator 202 requires more power to retract rod 210 than is available in the first mode with regeneration, pressure builds within passages 276, 278, 280, and 284 of the extend regeneration valve assembly 234 until the second pilot actuator 244 on control valve 240 is able to position control valve 240 to fully open position 240C. Pressurized hydraulic fluid is allowed to flow unobstructed through control valve 240 and through check valve 268 into third chamber 226 through third port 232.

In the second mode of operation, pressure also increases in passage 286, through priority valve 258, and pilot line 272. When the pressure in pilot line 272 exceeds a predetermined level, normally open pressure limiting valve 262 closes, removing pressure from pilot actuator 256 causing control valve to return to its normal position 254A. Thus, first chamber 222 and second chamber 224 are opened to drain through second conduit 266. As second port 230 is connected to drain through second conduit 266, pilot line 274 is unpressurized resulting in priority valve 258 being in its normally open state. Pressurized fluid is allowed to pass through priority valve 258, however, pressure is in pilot line 272 is sufficient to operate, and thereby closing, pressure limiting valve 262, preventing operation of pilot actuator 256, thereby resulting in control valve 254 being in its normally open position 254A, connecting first chamber 222 to conduit 266.

Figure 2C:
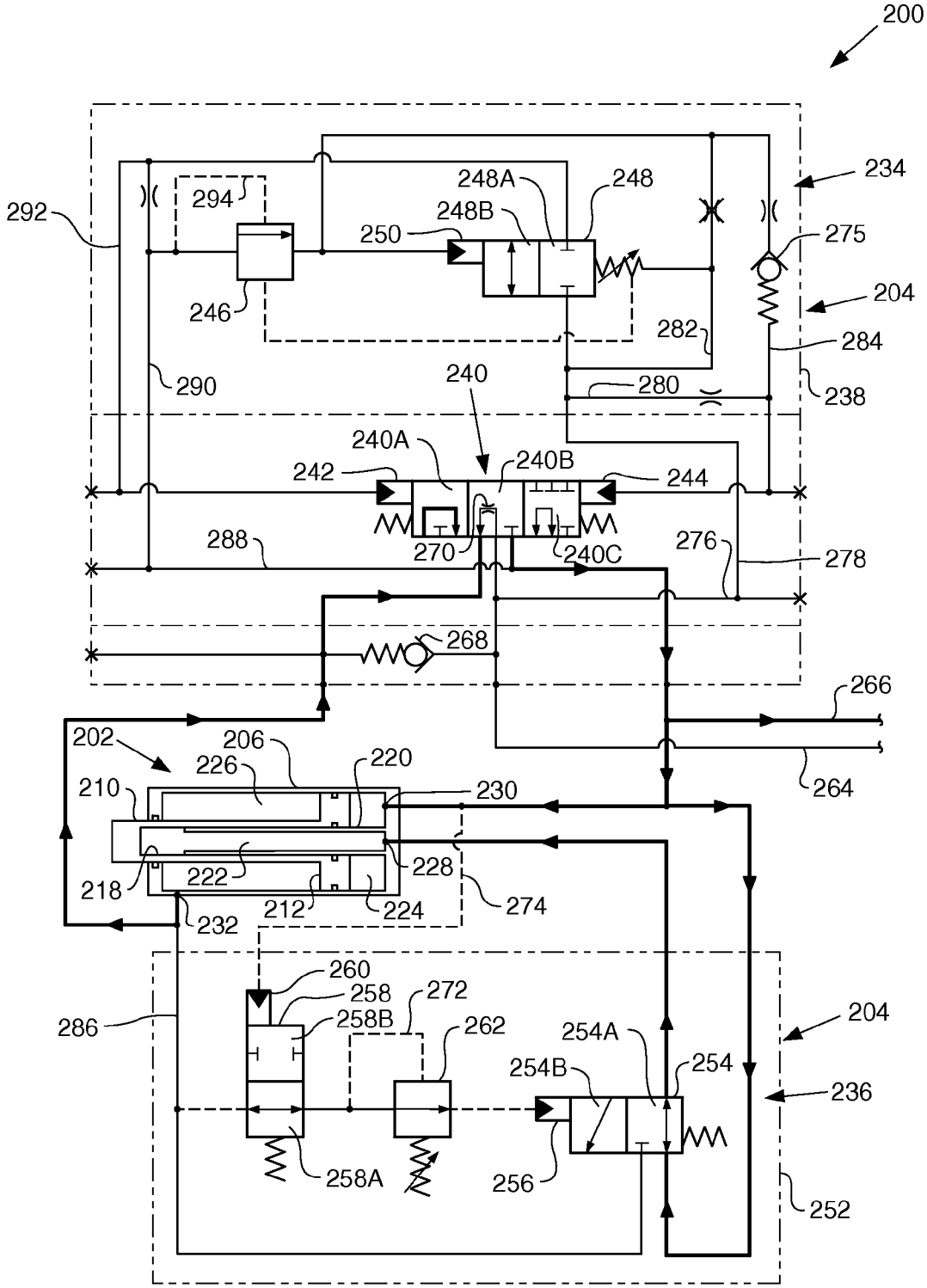
FIG. 2C is a schematic representation of the hydraulic system of FIG. 2 showing a fluid flow path in a third mode of operation.

In a third mode of operation, shown in FIG. 2C with the fluid flow path shown in bold, the hydraulic system 200 may be configured to extend the rod 210 of actuator 202 using regeneration by directing flow of hydraulic fluid out of the third chamber 226 and into the first chamber 222 and the second chamber 224. In this third mode of operation, pressurized hydraulic fluid is supplied by second conduit 266 and is introduced into the second chamber 224 through second port 230. Pressure in pilot line 274 is sufficient to operate pilot actuator 260, moving priority valve 258 from normally open position 258A to closed position 258B. Hydraulic pressure is prevented from communicating with pilot actuator 256 and control valve 254 is in its normally open position 254A, thereby directing hydraulic fluid from conduit 266 into first chamber 222 through first port 228. Hydraulic pressure increases within passages 288, 290, and 292 of the extend regeneration valve assembly 234 until pilot actuator 242 moves control valve 240 into position 240A. In this configuration, hydraulic fluid is allowed to flow out of third chamber 226, through third port 232, is directed through position 240A of control valve 240, and into the first chamber 222 and second chamber 224 through first and second ports 228, 230, respectively.

Figure 2D:
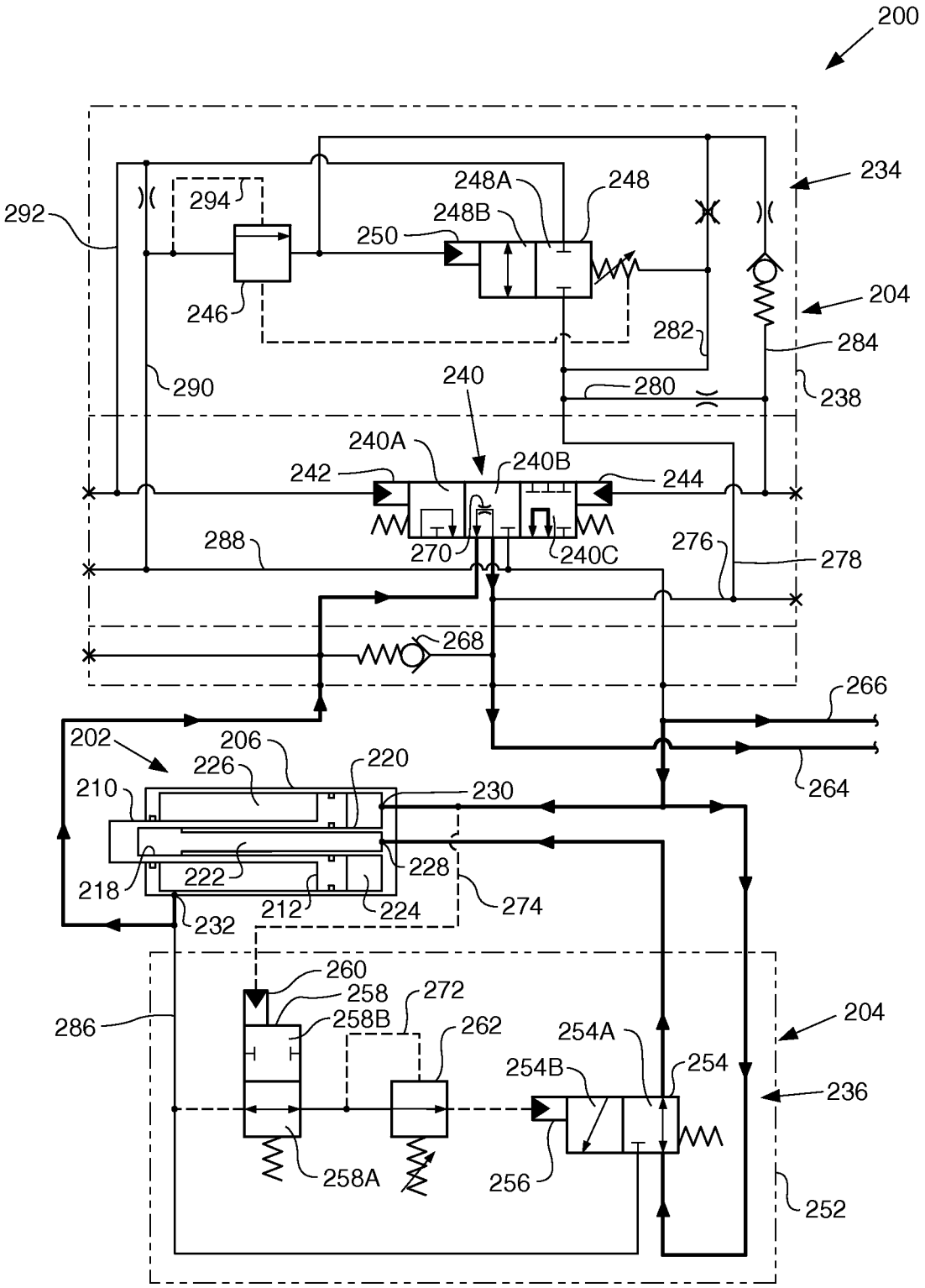
FIG. 2D is a schematic representation of the hydraulic system of FIG. 2 showing a fluid flow path in a fourth mode of operation.

In a fourth mode of operation, shown in FIG. 2D with the fluid flow path shown in bold, the hydraulic system 200 may be configured to extend the rod 210 of actuator 202 using full power by directing flow of hydraulic fluid into first chamber 222 and second chamber 224 through first port 228 and second port 230, respectively and out of the third chamber 226 through the third port 232 to drain. In this mode of operation, hydraulic fluid is supplied under pressure through second conduit 266 as shown in FIG. 2C and described previously. If there is a significant load on work implement 112 and actuator 202 requires more power to extend rod 210 than is available in the third mode with regeneration, pressure in pilot line 274 operates pilot actuator 260, causing priority valve 258 to move from its normally open position 258A to closed position 258B. Since no pressure is available to operate pilot actuator 256, control valve 254 remains in its normally open position 254A, allowing fluid communication between second conduit 266 and first chamber 222. Hydraulic pressure increases in passages 288, 290, and 292 within the extend regeneration valve assembly 234 until pressure in pilot line 294 is sufficient to open priority valve 246, allowing pressure to operate actuator 250 and open sequence valve 248 from normal position 248A to 248B and simultaneously operate pilot actuator 244. Control valve 240 is moved from position 240A, as in the third mode of operation, to position 240C, thereby connecting the third chamber 226 to first conduit 264 allowing for hydraulic fluid to flow from third chamber 226 to drain.

It will be apparent to those skilled in the art that various modifications can be made to the disclosed hydraulic system without departing from the scope of the invention. Other embodiments of the hydraulic system will be apparent to those skilled in the art from consideration of the specification and the practice of the hydraulic system disclosed herein. For example, although the disclosed hydraulic system has been described primarily for use with excavators and other machines, it is contemplated that a similar reinforcement device may be used with any hydraulic actuator. It is intended that the specification and examples be considered exemplary only, with a true scope being indicated by the following claims and their equivalents.

What is claimed is:

1. A hydraulic actuator system configured for bi-directional regeneration comprising:

an actuator comprising a hollow body including a first end and a second end, a rod disposed within the hollow body and extending outwardly from the second end of the hollow body, the rod including a first chamber within the rod, a piston disposed at one end of the rod, the piston in combination with the hollow body defining a second chamber and a third chamber, and a tube attached to the first end of the hollow body extending into the first chamber and configured to cooperate with the rod;

a first conduit and a second conduit; and a retract regeneration valve assembly and an extend regeneration valve assembly in fluid communication with the first conduit, the second conduit, the first chamber, the second chamber, and the third chamber, wherein the retract regeneration valve assembly includes a pressure limiting valve in fluid communication with a first control valve, and wherein the pressure limiting valve is configured to close when a pressure required to retract the rod into the hollow body exceeds a predetermined level, and closure of the pressure limiting valve results in the first control valve moving to a position wherein fluid flow from the first and second chambers is prevented from flowing back to the third chamber, and the extend regeneration valve assembly includes a sequence valve in fluid communication with a second control valve, and wherein the sequence valve is configured to open when a pressure required to extend the rod from the hollow body exceeds a predetermined level, and opening of the sequence valve results in the second control valve moving to a position wherein fluid flow from the third chamber is prevented from flowing back to the first and second chambers.

2. The hydraulic actuator system of claim 1 wherein the first conduit is configured as a pressure source and the second conduit is configured as a drain.

3. The hydraulic actuator system of claim 2 configured to operate in a first mode, wherein the retract regeneration valve assembly is configured to selectively couple the first conduit and the first chamber to the third chamber, and wherein the retract regeneration valve assembly is configured to selectively couple the second chamber to the second conduit.

4. The hydraulic actuator system of claim 2 configured to operate in a second mode, wherein the retract regeneration valve assembly is configured to selectively couple the first conduit to the third chamber and wherein the retract regeneration valve assembly is configured to selectively couple the second conduit to both the first chamber and the second chamber.

5. The hydraulic actuator system of claim 1 configured to operate in a third mode, wherein the extend regeneration valve assembly is configured to selectively couple the second conduit to both the first chamber and the second chamber and wherein the extend regeneration valve assembly is configured to selectively couple the first conduit to the third chamber.

6. The hydraulic actuator system of claim 1 wherein the second conduit is configured as a pressure source and the first conduit is configured as a drain.

7. The hydraulic system of claim 6 configured to operate in a fourth mode, wherein the extend regeneration valve assembly is configured to selectively couple the second conduit to both the first chamber and the second chamber and wherein the extend regeneration valve assembly is configured to selectively couple the third port to the first and second ports.

8. A method of providing bi-directional regeneration in a hydraulic actuator, the method comprising:

providing an actuator comprising a hollow body including a first end and a second end, a rod disposed within the hollow body and extending outwardly from the second end of the hollow body, the rod including a first chamber within the rod, a piston disposed at one end of the rod, the piston in combination with the hollow body defining a second chamber and a third chamber, and a tube attached to the first end of the hollow body extending into the first chamber and configured to cooperate with the rod;

providing a first conduit and a second conduit, wherein one of the first conduit and the second conduit is configured as a pressure source;

providing a retract regeneration valve assembly and an extend regeneration valve assembly in fluid communication with the first conduit, the second conduit, the first chamber, the second chamber, and the third chamber; and configure the retract regeneration valve assembly to include a pressure limiting valve in fluid communication with a first control valve, and wherein the pressure limiting valve is configured to close when a pressure required to retract the rod into the hollow body exceeds a predetermined level, and closure of the pressure limiting valve results in the first control valve moving to a position wherein fluid flow from the first and second chambers is prevented from flowing back to the third chamber, and the extend regeneration valve assembly includes a sequence valve in fluid communication with a second control valve, and wherein the sequence valve is configured to open when a pressure required to extend the rod from the hollow body exceeds a predetermined level, and opening of the sequence valve results in the second control valve moving to a position wherein fluid flow from the third chamber is prevented from flowing back to the first and second chambers.

9. The method of claim 8 further comprising configuring the first conduit as a pressure source and configuring the second conduit as a drain; and configuring the retract regeneration valve assembly to selectively couple the first conduit and the first chamber to the third chamber and to selectively couple the second chamber to the second conduit.

10. The method of claim 8 further comprising configuring the first conduit as a pressure source and configuring the second conduit as a drain; and configuring the retract regeneration valve assembly to selectively couple the first conduit to the third chamber to selectively couple the second conduit to both the first chamber and the second chamber.

11. The method of claim 8 further comprising configuring the extend regeneration valve assembly to selectively couple the second conduit to both the first chamber and the second chamber and to selectively couple the first conduit to the third chamber.

12. The method of claim 8 further comprising configuring the second conduit as a pressure source and configuring the first conduit as a drain; and configuring the extend regeneration valve assembly to selectively couple the second conduit to both the first chamber and the second chamber and to selectively couple the third chamber to the first chamber and the second chamber.

13. A machine comprising:

a first member and a second member pivotally connected to the first member;

an actuator comprising a hollow body including a first end and a second end, a rod disposed within the hollow body and extending outwardly from the second end of the hollow body, the rod including a first chamber within the rod, a piston disposed at one end of the rod, the piston in combination with the hollow body defining a second chamber and a third chamber, and a tube attached to the first end of the hollow body extending into the first chamber and configured to cooperate with the rod, wherein the actuator is coupled to the first member and the second member;

a first conduit and a second conduit; and a retract regeneration valve assembly and an extend regeneration valve assembly in fluid communication with the first conduit, the second conduit, the first chamber, the second chamber, and the third chamber, wherein the retract regeneration valve assembly includes a pressure limiting valve in fluid communication with a first control valve, and wherein the pressure limiting valve is configured to close when a pressure required to retract the rod into the hollow body exceeds a predetermined level, and closure of the pressure limiting valve results in the first control valve moving to a position wherein fluid flow from the first and second chambers is prevented from flowing back to the third chamber, and the extend regeneration valve assembly includes a sequence valve in fluid communication with a second control valve, and wherein the sequence valve is configured to open when a pressure required to extend the rod from the hollow body exceeds a predetermined level, and opening of the sequence valve results in the second control valve moving to a position wherein fluid flow from the third chamber is prevented from flowing back to the first and second chambers.

14. The machine of claim 13 wherein the first conduit is configured as a pressure source and the second conduit is configured as a drain.

15. The machine of claim 14 configured to operate in a first mode, wherein the retract regeneration valve assembly is configured to selectively couple the first conduit and the first chamber to the third chamber, and wherein the retract regeneration valve assembly is configured to selectively couple the second chamber to the second conduit.

16. The machine of claim 14 configured to operate in a second mode, wherein the retract regeneration valve assembly is configured to selectively couple the first conduit to the third chamber and wherein the retract regeneration valve assembly is configured to selectively couple the second conduit to both the first chamber and the second chamber.

17. The machine of claim 13 configured to operate in a third mode, wherein the extend regeneration valve assembly is configured to selectively couple the second conduit to both the first chamber and the second chamber and wherein the extend regeneration valve assembly is configured to selectively couple the first conduit to the third chamber.

18. The machine of claim 13 wherein the second conduit is configured as a pressure source and the first conduit is configured as a drain.

19. The machine of claim 18 configured to operate in a fourth mode, wherein the extend regeneration valve assembly is configured to selectively couple the second conduit to both the first chamber and the second chamber and wherein the extend regeneration valve assembly is configured to selectively couple the third chamber to the first and second chambers.

* * * * *